US009106991B1

(12) United States Patent
Torres, Jr.

(10) Patent No.: US 9,106,991 B1
(45) Date of Patent: Aug. 11, 2015

(54) SPEAKER CABINET

(71) Applicant: Pelegrin Torres, Jr., Lomita, CA (US)

(72) Inventor: Pelegrin Torres, Jr., Lomita, CA (US)

( * ) Notice: Subject to any disclaimer, the term of this patent is extended or adjusted under 35 U.S.C. 154(b) by 13 days.

(21) Appl. No.: 14/249,655

(22) Filed: Apr. 10, 2014

(51) Int. Cl.
*H04R 1/26* (2006.01)
*H04R 1/02* (2006.01)

(52) U.S. Cl.
CPC ..... *H04R 1/02* (2013.01)

(58) Field of Classification Search
CPC ..... H04R 1/26
USPC ..... 181/145, 144, 147
See application file for complete search history.

(56) References Cited

U.S. PATENT DOCUMENTS

| | | | | |
|---|---|---|---|---|
| D72,113 | S | 3/1927 | Rypinski | |
| 4,593,784 | A * | 6/1986 | Flanders | 181/144 |
| 4,657,107 | A * | 4/1987 | Harwood | 181/144 |
| 5,309,518 | A * | 5/1994 | Ickler et al. | 381/336 |
| 5,502,772 | A | 3/1996 | Felder | |
| 7,201,251 | B1 * | 4/2007 | Baird | 181/145 |
| 8,430,201 | B1 | 4/2013 | Weidner | |
| 8,967,323 | B1 * | 3/2015 | Grenier | 181/199 |
| 2006/0072773 | A1 * | 4/2006 | Hughes et al. | 381/304 |

FOREIGN PATENT DOCUMENTS

| | | |
|---|---|---|
| CN | 202957958 U | 5/2013 |
| EP | 1571871 A1 | 9/2005 |

OTHER PUBLICATIONS

Doctorbass.net, TecAmp Virtue Cabinet, Catalog, Germany http://www.doctorbass.net/v5xen/c/?iddoc=1005172602.
Photobucket.com, Epiphone Speaker Cabinet, Photo http://i172.photobucket.com/albums/w37/stonge007/P1000432.jpg.
Forum.luckymojo.com, Altars: Questions and Answers, Forum, Feb. 25, 2011, United States http://forum.luckymojo.com/altars-questions-and-answers-t124s240.html.
Diyaudio.com, MDF v. Plywood Construction, Forum, Feb. 16, 2005 http://www.diyaudio.com/forums/multi-way/51746-mdf-v-plywoodconstruction.html.
Thegearpage.net, 2×12?ported, convertible?. . . etc to replace Bogner 4×12, Forum, Mar. 29, 2013 http://www.thegearpage.net/board/archive/index.php/t-1240431.html.
Origami.com, Titan 3 Power Plus, Catalog http://www.0rigami.com/gg/amps3.html#Titan-III_Power-Plus.
(Continued)

*Primary Examiner* — Forrest M Phillips
(74) *Attorney, Agent, or Firm* — Hankin Patent Law, APC; Marc E. Hankin; Anooj Patel

(57) ABSTRACT

A speaker cabinet. The speaker cabinet may comprise: a primary speaker cabinet, sound chambers, speakers, one or more sound holes, and a switch. The speakers may comprise a first set and a second set of speakers and may be enclosed in the primary speaker cabinet, such that the speakers are disposed in a radially symmetric manner. Each of the speakers may be individually chambered inside the primary speaker cabinet, such that each of the speakers is double enclosed. The speaker cabinet may lack a dampening material. The speaker cabinet may be constructed of a dense, thin, and solid wood. The sound hole may be positioned at an upper portion of the left or right side of the speaker cabinet. The switch such as a foot switch may be configured to select between the first set and the second set of the speakers for producing sound.

20 Claims, 9 Drawing Sheets

(56) References Cited

OTHER PUBLICATIONS

Audiokarma.org, Wiring a three way switch for two speakers in a guitar cab, Forum, Jul. 18, 2011 http://www.audiokarma.org/forums/archive/index.php/t-382136.html.
Talkbass.com, Mixing Cabinets and Phase Response, Forum, Nov. 2002 http://www.talkbass.com/forum/f15/mixing-cabinets-phase-response-607556/.
Gerardskeyboards.com, Walker 3 Sided Speaker Cabinet, Photo http://gerardskeyboards.com/Instruments/Walker%203%20sided%20Speaker%20Cabinet.JPG.
Eminence.com, Sealed vs. Ported Enclosures, Article http://www.eminence.com/2011/06/sealed-vs-ported-enclosures/.
Avforums.com, Why are so many speakers rear ported!?, Forum, Feb. 7, 2012 http://www.avforums.com/threads/why-are-so-many-speakers-rearported.1588359/.

* cited by examiner

SPEAKER CABINET

FIELD OF INVENTION

This invention relates generally to audio equipment, and, more specifically, to speaker cabinets with unique features configured to enhance sound.

BACKGROUND

Musicians may spend years of practice to become proficient with their musical instruments, but the sound produced to the listener is generally only as good as the equipment used by the musician. Thus, most musicians understand the importance of utilizing the right equipment, which includes not only the instruments themselves but the peripherals as well. Importantly, speakers, loudspeakers, and amplification devices are commonly used in conjunction with certain instruments in order to make the sound loud enough to fill a particular venue.

While various types of speakers and speaker cabinet designs exist, many musicians do not fully understand the technicalities and importance of sound engineering and are generally not inclined to design the specific and optimal speaker cabinet for their needs. Rather, most musicians prefer to purchase conventional and off the rack speaker cabinets, which are moderately useful in a variety of general purpose situations. Although most conventional speaker cabinets generally use only one speaker, some speaker cabinets do use multiple speakers, but generally the multiple speakers are of the same type.

Current speaker cabinets generally use speakers of the same size or type due to concerns of sound cancellation. Specifically, when the same sound and frequency emanates from two or more speakers at the same time, some of the sound waves may be cancelled or otherwise impaired. This generally occurs because, when two or more sound waves produced by speakers at different physical locations arrive at a certain point in space (but at different phases), the first sound wave effectively acts to counter the second sound wave.

These sound cancellation properties are commonly used in active noise cancellation headphone technology. In noise cancellation technology, when sound waves are detected by microphones, a similar sound is produced by a speaker in the opposite phase in order to eliminate the sound. Thus, these noise cancellation properties have been known to be used to either cancel or produce sound.

Because sound cancellation may be unpredictable and difficult to overcome, it is generally preferable to minimize sound cancellation occurring in the first place. Most conventional speaker cabinets simply reduce the possibility of sound cancellation by using the same type of speakers and by using as few speakers as possible. Using the same type of speakers results in sound cancellation that is easier to identify and overcome, as compared to overcoming sound cancellation caused by speakers of different types or sizes.

On the other hand, there are significant benefits to simultaneously using multiple speakers, and speakers of varying sizes, in the same speaker cabinet. Larger speakers tend to produce deeper sounds, whereas smaller speakers tend to produce higher pitched sounds. In combination, more sound depth can conceivable be delivered from a speaker cabinet with a mix of speakers.

Therefore, there remains a need for a speaker cabinet that overcomes the above deficiencies. Preferably, the speaker cabinet may be configured with multiple speaker sizes, and be able to minimize sound cancellation. The speaker cabinet may also be preferably configured to be used at residential and public venues.

BRIEF SUMMARY OF THE INVENTION

To minimize the limitations in the cited references, and to minimize other limitations that will become apparent upon reading and understanding the present specification, the following discloses a new and useful speaker cabinet.

One embodiment may be a speaker cabinet, comprising: a primary speaker cabinet; at least four sound chambers; and at least four speakers; wherein the at least four sound chambers contain the at least four speakers; wherein the at least four sound chambers are substantially enclosed within the primary speaker cabinet; and wherein the at least four sound chambers are arranged in a radially symmetric manner in the primary speaker cabinet, such that, at least two of the at least four sound chambers are disposed vertically and horizontally asymmetrical in size, but are diagonally symmetrical in size. The at least four speakers may comprise a first set of speakers and a second set of speakers; wherein the first set of speakers may be the same size as each other; wherein the second set of speakers may be the same size as each other; and wherein the first and second set of speakers may be different sizes. The speaker cabinet may further comprise: a plurality of partitions; wherein the plurality of partitions may be configured to divide an interior of the primary speaker cabinet into a plurality of compartments; and wherein each of the plurality of compartments may be configured to receive each of the at least four sound chambers. The primary speaker cabinet and the at least four sound chambers may lack a dampening material. The primary speaker cabinet may be constructed of a wood. The wood may be dense, thin, and solid. The primary speaker cabinet may comprise one or more sound holes. The one or more sound holes may be positioned at an upper portion of at least one side of the primary speaker cabinet. At least one of the at least four sound chambers may comprise the one or more sound chamber sound holes. The one or more sound chamber sound holes may substantially match up with the one or more sound holes of the primary speaker cabinet, such that sound may emanate through both the one or more sound chamber sound holes and the one or more sound holes of the primary speaker cabinet. The speaker cabinet may further comprise: a switch; wherein the switch may comprise an input and at least two outputs; wherein the input of the switch may be configured to receive an amped sound signal sent by an amplified musical instrument; wherein the at least two outputs of the switch may be configured to connect to the first set of speakers and the second set of speakers; and wherein the switch may be configured to allow a user to toggle between the first set of speakers, the second set of speakers, and both of the sets of speakers such that the amped sound signal created by the amplified musical instrument may be produced from the first set of speakers, the second set of speakers, or both of the sets of speakers.

Another embodiment may be a speaker cabinet, comprising: a primary speaker cabinet; at least four sound chambers; and at least four speakers; wherein the at least four sound chambers contain the at least four speakers; wherein the at least four sound chambers are substantially enclosed within the primary speaker cabinet; and wherein the at least four sound chambers are arranged in a radially symmetric manner in the primary speaker cabinet, such that, at least two of the at least four sound chambers are disposed vertically and horizontally asymmetrical in size, but are diagonally symmetrical in size. The at least four speakers may comprise a first set of speakers and a second set of speakers; wherein the first set of the one or more speakers may be ten inch speakers; wherein the second set of the one or more speakers may be twelve inch speakers. The primary speaker cabinet and the at least four sound chambers may lack a dampening material. The primary speaker cabinet may be constructed of a wood; wherein the wood may be dense, thin, and solid. The primary speaker cabinet may comprise one or more sound holes. The one or more sound holes may be positioned at an upper portion of at least one side of the primary speaker cabinet. At least one of the at least four sound chambers may comprise the one or more sound chamber sound holes. The one or more sound chamber sound holes may substantially match up with the one or more sound holes of the primary speaker cabinet, such that sound may emanate through both the one or more sound chamber sound holes and the one or more sound holes of the primary speaker cabinet.

Another embodiment may be a speaker cabinet, comprising: a primary speaker cabinet; four sound chambers; four speakers; a plurality of partitions; and a switch; wherein the four sound chambers contain the four speakers; wherein the four speakers comprise ten inch speakers and twelve inch speakers; wherein the four sound chambers are substantially enclosed within the primary speaker cabinet; wherein the four sound chambers are arranged in a radially symmetric manner in the primary speaker cabinet, such that, two of the four sound chambers are disposed vertically and horizontally asymmetrical in size, but are diagonally symmetrical in size; wherein the primary speaker cabinet and the four sound chambers lack a dampening material; wherein the primary speaker cabinet is constructed of a wood; wherein the wood is dense, thin, and solid; wherein the primary speaker cabinet comprises a first sound holes and a second sound hole; wherein the first sound hole is positioned at an upper portion of a right side of the primary speaker cabinet; wherein the second sound hole is positioned at an upper portion of a left side of the primary speaker cabinet; wherein two of the four sound chambers also comprise the first sound chamber sound hole and the second sound chamber sound hole; wherein the first sound chamber sound hole substantially match up with the first sound hole of the primary speaker cabinet, such that sound may emanate through both the first sound chamber sound hole and the first sound hole of the primary speaker cabinet; wherein the second sound chamber sound hole substantially match up with the second sound hole of the primary speaker cabinet, such that sound may emanate through both the second sound chamber sound hole and the second sound hole of the primary speaker cabinet; wherein the plurality of partitions are configured to divide an interior of the primary speaker cabinet into four compartments; wherein each of the four compartments are configured to receive each of the four sound chambers; wherein the switch comprises an input and at least two outputs; wherein the input of the switch is configured to receive an amped sound signal sent by an amplified musical instrument; wherein the at least two outputs of the switch are configured to connect to the first set of speakers and the second set of speakers; and wherein the switch is configured to allow a user to toggle between the first set of speakers, the second set of speakers, and both of the sets of speakers such that the amped sound signal created by the amplified musical instrument is produced from the first set of speakers, the second set of speakers, or both of the sets of speakers.

It is an object to provide a speaker cabinet that may allow a user to increase control of the output sound in order to suit the specific and general needs of the user.

It is an object to provide a speaker cabinet with sound holes that may release sound through the left and/or rights sides of the speaker cabinet to increase resonance.

It is an object to provide a speaker cabinet that increases the dynamic range of the audio spectrum.

It is an object to provide a speaker cabinet constructed of solid, thin, and dense wood. Preferably the wood may be between 0.25 to 1 inches (0.635 to 2.54 centimeters) thick.

It is an object to provide a speaker cabinet that lacks dampening material such as textures, coatings (e.g., Tolex® coating), or coverings, in order to encourage resonance at specific low to mid frequency ranges.

One embodiment may be a speaker cabinet with a unique foot switch system that operates of one or more sets of speakers. In a preferred embodiment, the speaker cabinet may control three (3) sets of speakers (10 inch speakers, 12 inch speakers, or both 10 inch and 12 inch speakers) or (25.4 cm speakers, 30.48 cm speakers, or both 25.4 cm and 30.48 cm speakers).

One embodiment may be a speaker cabinet with speakers of multiple sizes that are chambered individually within a single speaker cabinet.

One embodiment may be a speaker cabinet, in which each of the different pair of speakers are arranged vertically asymmetrical, but diagonally symmetrical.

One embodiment may be a speaker cabinet in which each speaker is individually enclosed within one of several multiple chamber designs within the speaker cabinet.

It is an object of the new apparatus to remedy the deficiencies of the prior art.

Other features and advantages are inherent in the speaker cabinet claimed and disclosed will become apparent to those skilled in the art from the following detailed description and its accompanying drawings.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps.

DETAILED DESCRIPTION OF ILLUSTRATIVE EMBODIMENTS

Figure 1:
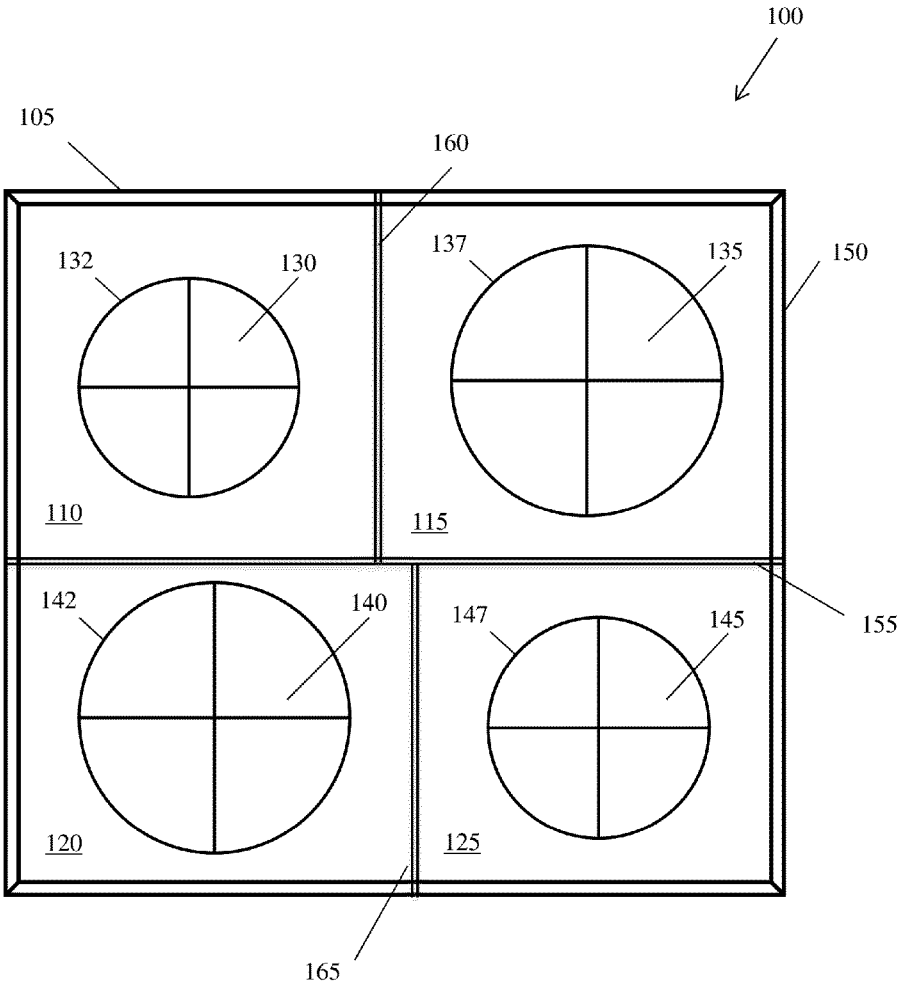
FIG. 1 is an illustration of one embodiment of the speaker cabinet and shows one possible arrangement of the sound chambered speakers within a speaker cabinet.

In the following detailed description of various embodiments of the invention, numerous specific details are set forth in order to provide a thorough understanding of various aspects of one or more embodiments of the invention. However, one or more embodiments of the invention may be practiced without some or all of these specific details. In other instances, well-known methods, procedures, and/or components have not been described in detail in order to prevent unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the graphs, figures, and detailed descriptions thereof, are to be regarded as illustrative in nature and not restrictive. Also, the reference or non-reference to a particular embodiment of the invention shall not be interpreted to limit the scope of the invention.

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

In the following description, certain terminology is used to describe certain features of one or more embodiments of the invention. For example, a surface that is "substantially" flat would mean that the object is either completely flat or nearly completely flat. The exact allowable degree of deviation from absolute completeness may in some cases depend on the specific context. However, generally speaking, the nearness of completion will have the same overall result as if absolute and total completion were obtained. The use of "substantially" is equally applicable when used in a negative connotation to refer to the complete or near complete lack of an action, characteristic, property, state, structure, item, or result.

As used herein, the terms "rotational symmetry", "radial symmetry", "rotationally symmetric", and "radial symmetric" generally refer to the characteristic in which an object appears to be the same after rotating the object into a certain number of degrees. In other words, if the object is rotated at a center point by fewer than 360 degrees, the object appears unchanged. There may be different types of radial symmetry, usually designated by a number, and each number may have a degree associated with it. For example, the degree to be rotated for an identical image may be related to the number as follows: degrees to be rotated=360°/n (180°, 120°, 90°, 72°, 60°, 51⅗°, etc. . . . ), wherein n is the rotational symmetry of order. Thus, the notation for n-fold symmetry may be Cn or simply "n". Specifically, $C_1$ radial symmetry may mean that the object may be rotated 180 degrees and the resulting view is identical to the original view. $C_2$ radial symmetry may mean that the object may be rotated 120 degrees and the resulting view is identical to the original view. $C_3$ radial symmetry may mean that the object may be rotated 90 degrees and the resulting view is identical to the original view.

As used herein, the term "wood" generally refers to any hard, fibrous substance suitable for construction and other purposes. Wood may refer to any type of wood, including a combination of different woods and synthetic wood, and may be dense, thin, and solid.

As used herein, the term "dampening material" means any additional material that may add or cover the wood of the speaker cabinet. Common dampening material may include without limitation, vinyl coatings (e.g., Tolex®), latex, paints, synthetic coatings, textured coatings, and other materials suitable for coating a speaker cabinet.

As used herein, the term "musical instrument" generally refers to any device created or adapted to make musical sounds, including without limitation, drums, marimbas, pianos, keyboards, guitars (e.g., acoustic guitar, electric guitar), organs, synthesizers, media players (e.g., MP3 players, CD players), record players, and the like. In an embodiment, the musical instrument may be an electric or acoustic guitar.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on the individual member's presentation in a common group without indications to the contrary.

Figure 8:
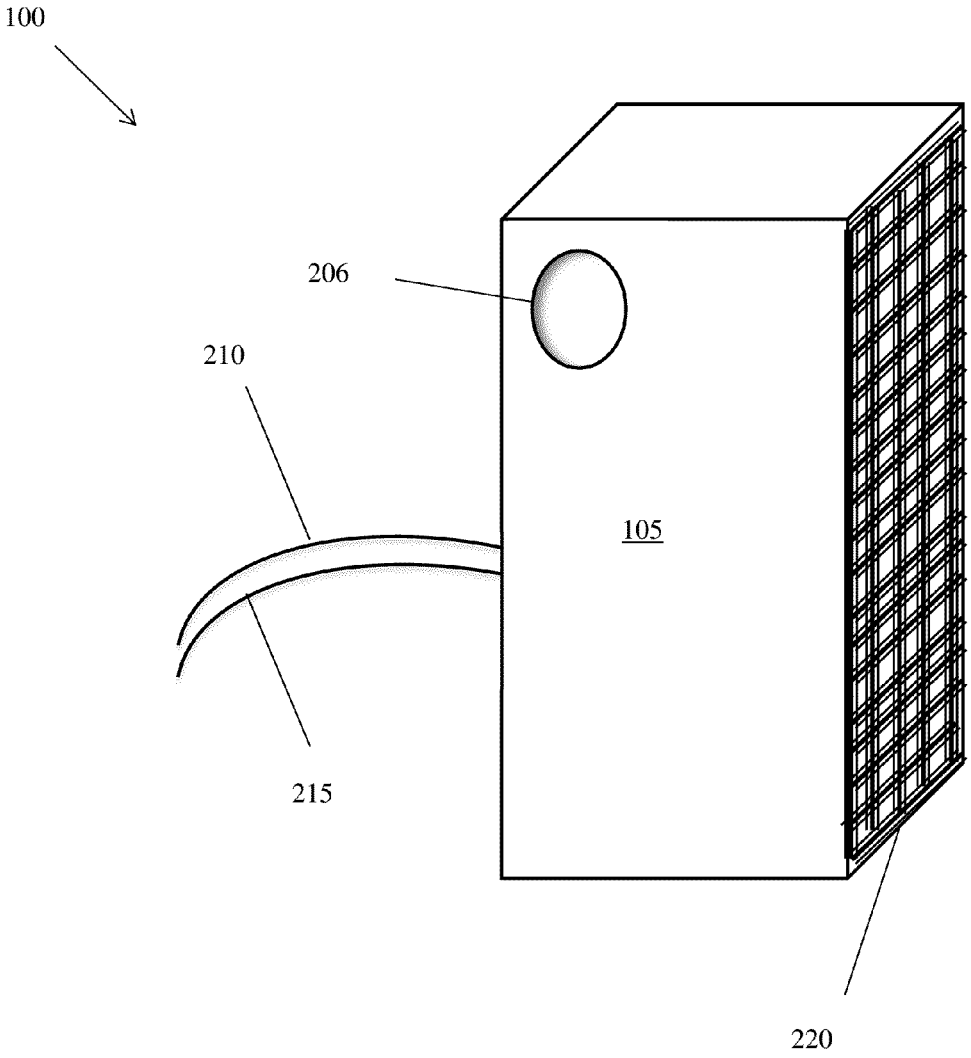
FIG. 8 is an illustration of a front perspective view of one embodiment of the speaker cabinet and shows the right and front sides of the speaker cabinet.

FIG. 1 is an illustration of one embodiment of the speaker cabinet and shows one possible arrangement of the sound chambered speakers within a speaker cabinet. As shown in FIG. 1, one embodiment of the speaker cabinet 100 may comprise: a primary speaker cabinet 105; sound chambers 110, 115, 120, 125, speaker holes 132, 137, 142, 147, and speakers 130, 135, 140, 145. As shown, the sound chambers 110, 115, 120, 125 may contain speakers 130, 135, 140, 145. The primary speaker cabinet 105 may comprise: an exterior wall 150, horizontal partition 155, first vertical partition 160, and second vertical partition 165. The primary speaker cabinet 105 is generally a substantially rectangular or square case or housing configured to enclose or encase the sound chambers 110, 115, 120, 125 and speakers 130, 135, 140, 145. The primary speaker cabinet 105 is generally constructed of a thin and dense solid wood, but may be constructed of any manmade or non-manmade material. Each side of the exterior wall 150 of the primary speaker cabinet 105 is generally rectangular or square in shape and may be between approximately ¼ inches to 1 inch (0.635 centimeters to 2.54 centimeters) thick. The exterior wall may have five sides (top, bottom, back, left side, and right side) and a front that comprises a screen 220, as shown in FIG. 8. The horizontal partition 155, first vertical partition 160, and second vertical partition 165 are generally used to partition the primary speaker cabinet 105 into four smaller compartments or chambers, and each partition may be between approximately ¼ inches to ½ inches (0.635 centimeters to 1.27 centimeters) thick. In a preferred embodiment, the exterior wall 150 is generally ¼ inches (0.635 centimeters) thick while the horizontal partition 155, first vertical partition 160, and second vertical partition 165 are generally ¼ inches (0.635 centimeters) thick. Additionally, while most conventional speaker cabinets are generally covered or coated in dampening material such as vinyl or latex, in a preferred embodiment, the components of the primary speaker cabinet 105 disclosed herein preferably lack dampening material such as textures, coatings (e.g., vinyl, latex), and other types of coverings in order to increase and enhance sound resonance through the speaker cabinet 100. Although FIG. 1 shows speaker cabinet 100 configured to hold and secure four sound chambers, the speaker cabinet 100 may be configured to hold any number of sound chambers.

FIG. 1 shows that the four sound chambers 110, 115, 120, 125, may be divided into two sets—i.e., a first set and second set. Specifically, the first set generally comprises a first speaker chamber 110 with speaker 130 (which may be placed in the upper left partitioned area of primary speaker cabinet 105) and second speaker chamber 125 with speaker 145 (which may be placed in the lower right partitioned area of primary speaker cabinet 105), both typically have the same speaker size. Similarly, the second set generally comprises a third speaker chamber 115 with speaker 135 (which may be placed in the upper right partitioned area of primary speaker cabinet 105) and fourth speaker chamber 120 with speaker 140 (which may be placed in the lower left partitioned area of primary speaker cabinet 105), which are also typically the same size as each other (but preferably a different size than the first set of speakers). As shown in FIG. 1, the speaker cabinet 100 may have a radial symmetry, such that the first set and second set of sound chambers and speakers are disposed asymmetrical vertically and horizontally, but are diagonally symmetrical.

As shown, speakers 130 and 145 are preferably the same size as each other, and speakers 135 and 140 are also generally the same size as each other, but the speaker sets are generally of a different size from the other set. In a preferred embodiment, the speakers 130 and 145 may be 10" speakers while speakers 135 and 140 may be 12" speakers. Thus, because 10" speakers and 12" speakers may be used in the same speaker cabinet 100, the acoustic spectrum produced from that speaker cabinet 100 may be greater than a speaker cabinet that features speakers of a single size (e.g., a speaker cabinet with multiple speakers, but wherein all of the speakers are only 10" speakers or only 12" speakers).

In another embodiment, speakers 130 and 145 may be 8" speakers while the speakers 135 and 140 may be 10" speakers. Because 8" speakers and 10" speakers may be used in the same speaker cabinet, the range of sound is generally greater than a speaker cabinet with only 8" speakers or 10" speakers. The two speaker sizes may be of any size without deviating from the scope of the invention.

FIG. 1 also shows that the horizontal partition 155, first vertical partition 160, and second vertical partition 165 may, when taken together with the exterior wall 150, form partitioned areas, slots, or sections for sound chambers 110, 115, 120, 125. As shown in FIG. 1, the horizontal partition 155 may traverse perpendicularly from one side of the exterior wall 150 to the opposite side of the exterior wall 150. The first vertical partition 160 may connect perpendicularly from one side of the horizontal partition 155 to the exterior wall 150. Similarly, the second vertical partition 165 may connect perpendicularly from the horizontal partition 155 to the exterior wall 150. The position of the first vertical partition 160 and second vertical partition 165 may be staggered. Specifically, while both the vertical partition 160 and second vertical partition 165 may be perpendicular to the exterior wall 150 and horizontal partition 155, the first vertical partition 160 and second vertical partition 165 generally do not connect to the horizontal partition 145 at the same point, which may result in formation of horizontally and vertically asymmetric slots for sound chambers 110, 115, 120, 125. Alternatively, the radial symmetry may be accomplished by having a single vertical partition and two horizontal partitions by switching where the two speaker sets are placed.

Figure 2:
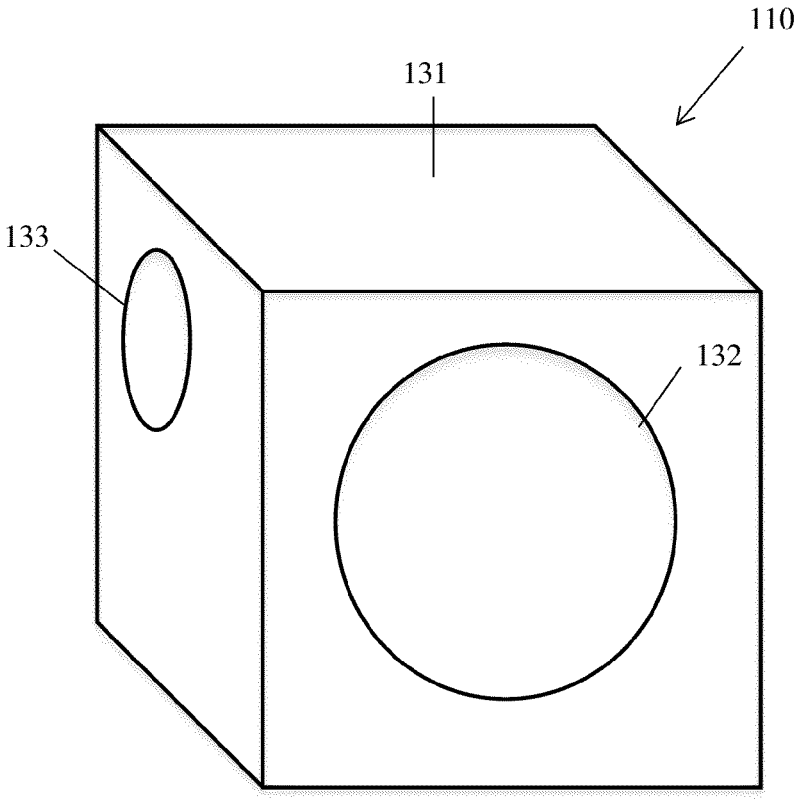
FIG. 2 is an illustration of a perspective view of one embodiment of the upper left sound chambered speaker to be placed in the speaker cabinet.
Figure 4:
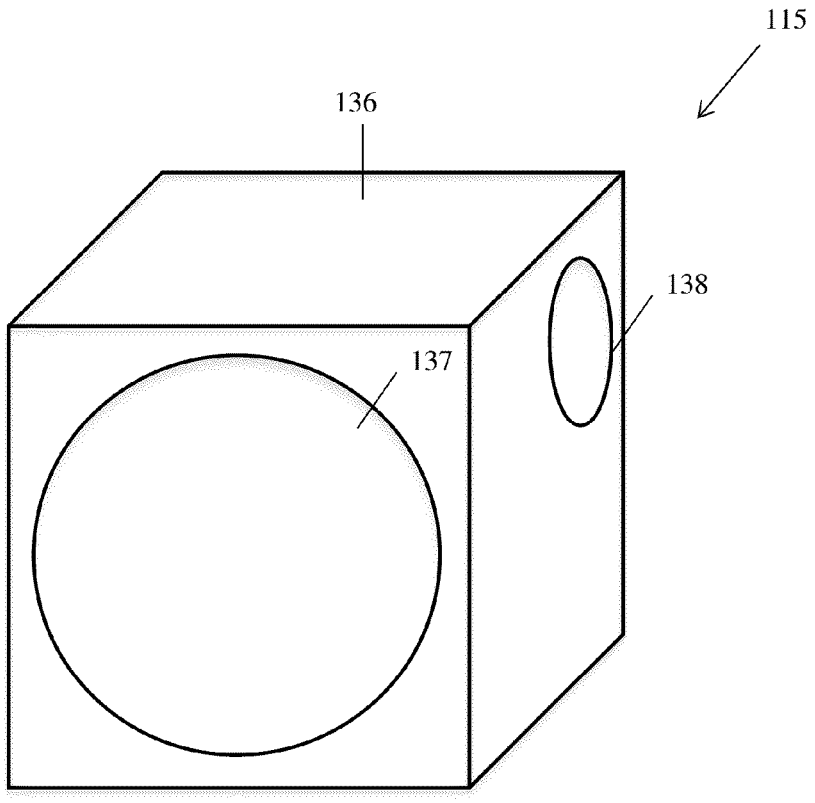
FIG. 4 is an illustration of a perspective view of one embodiment of the upper right sound chambered speaker to be placed in the speaker cabinet.

FIG. 2 is an illustration of a perspective view of one embodiment of the upper left sound chambered speaker to be placed in the speaker cabinet. As shown in FIG. 2, one embodiment of the sound chamber 110 may comprise: a casing 131, speaker hole 132 (typically unscreened), and sound hole 133. The casing 131 is generally a box-like structure or cubed shaped device configured to house a speaker. The casing 131 may comprise a speaker hole 132 for securely attaching speaker 130 (shown in FIG. 1) and a sound hole 133 to allow sound to emanate from the right side of the speaker cabinet 100. As shown in FIG. 8, sound hole 133 typically matches up with sound hole 206 of primary speaker cabinet 105 in order to emanate from that side of the speaker cabinet 100. The sound hole 133 generally allows sound produced by the musical instrument to resonate differently from the upper speakers than the lower sound chambers and speakers, which do not have sound holes on the sides, back, bottom, or top, thereby widening the frequency response from the speaker cabinet 100. Typically, the upper left and upper right sound chambers may have at least one sound hole 133 (and 138, which is shown in FIG. 4). Although the sound hole 133 is preferably on the right, it may be on top or back without deviating from the scope of the invention. In one embodiment, the sound chamber 110 may be configured for a 10" speaker. In a preferred embodiment, the sound hole 133 may be approximately four inches in diameter.

The sound hole 133 is generally configured to provide additional sound/resonance and usually helps relieve air pressure naturally created by the movement of the speaker housed within the sound chamber 110 with the sound hole 133. This generally creates a natural variance in tonality between the corresponding lower sound chambers 120, 125 and the upper sound chambers 110, 115 containing the sound holes.

Figure 3:
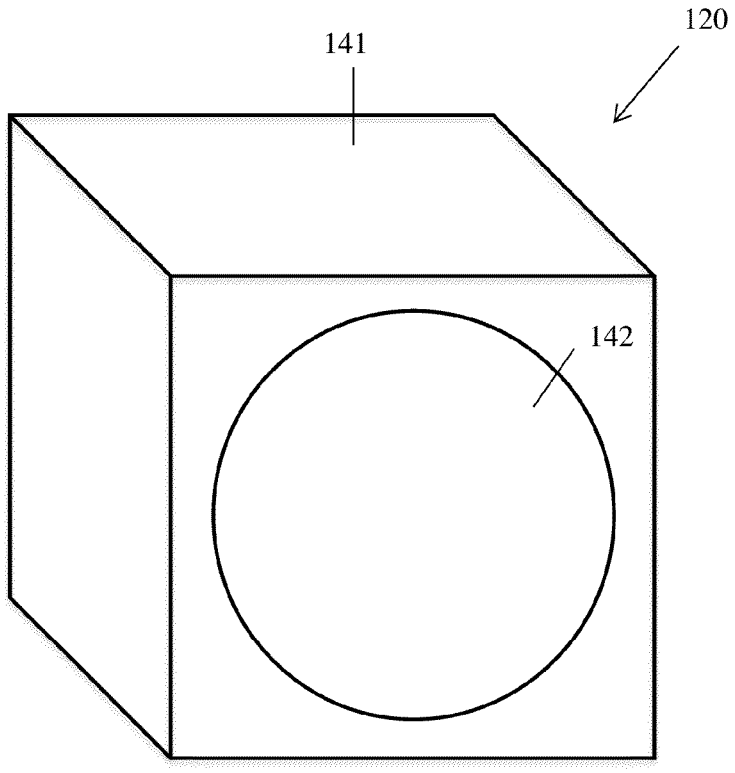
FIG. 3 is an illustration of a perspective view of one embodiment of the lower left sound chambered speaker to be placed in the speaker cabinet.

FIG. 3 is an illustration of a perspective view of one embodiment of the lower left sound chambered speaker to be placed in the speaker cabinet. As shown in FIG. 3, one embodiment of the sound chamber 120 may comprise: a casing 141 and speaker hole 142. Casing 141 may comprise a speaker hole 142 for securely attaching a speaker 140 (shown in FIG. 1). In one embodiment, the sound chamber 120 may be configured for a 12" speaker. Because sound chamber 120 is in a lower portioned area, it preferably does not have a sound hole. In an alternate embodiment the sound holes may be on the lower speaker(s) and not in the upper speaker(s).

Figure 7:
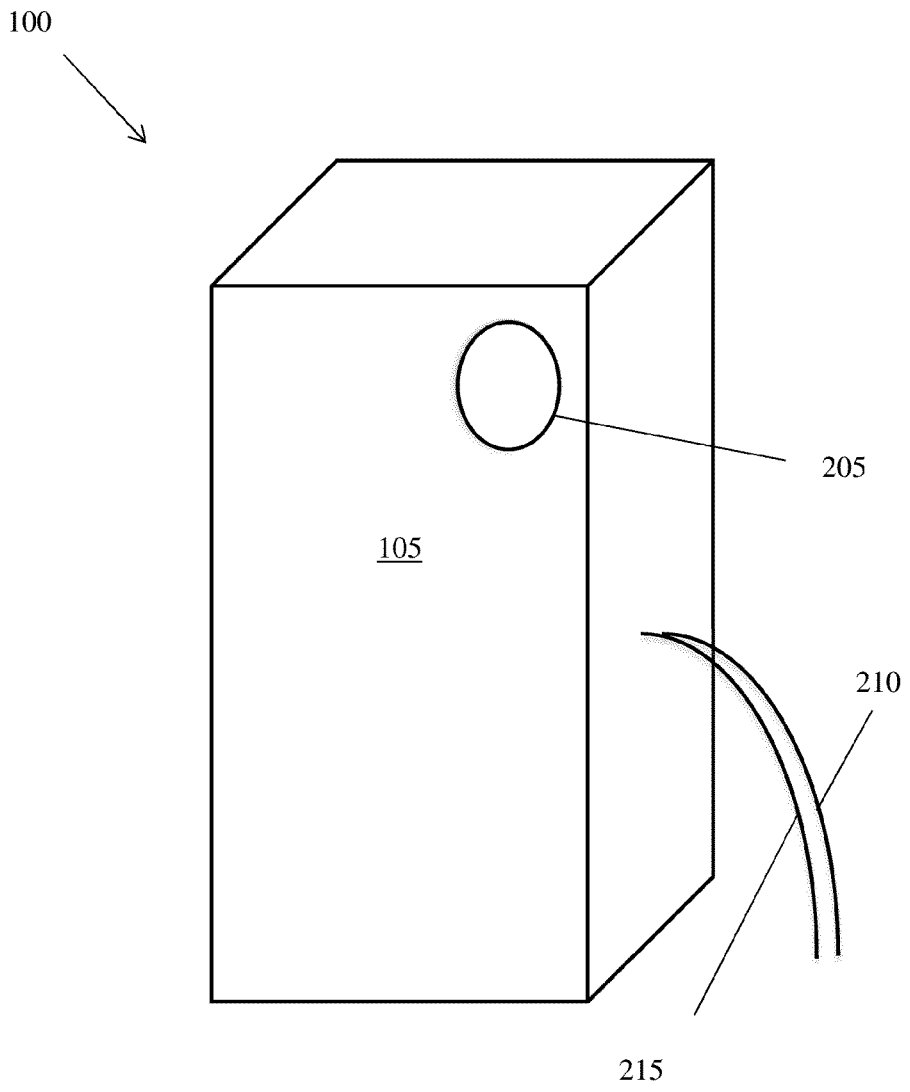
FIG. 7 is an illustration of a rear perspective view of one embodiment of the speaker cabinet and shows the left and back sides of the speaker cabinet.

FIG. 4 is an illustration of a perspective view of one embodiment of the upper right sound chambered speaker to be placed in the speaker cabinet. As shown in FIG. 4, one embodiment of the sound chamber 115 may comprise: a casing 136, speaker hole 137, and sound hole 138. Like the sound chambers 110, 120 shown in FIGS. 2 and 3, the casing 136 is generally a box-like structure that is configured to house a speaker. The casing 136 may comprise a speaker hole 137 for securely attaching a speaker 135 and a sound hole 138 to allow sound to emanate from the left side of the speaker cabinet 100. As shown in FIG. 7, sound hole 138 typically matches up with sound hole 205 of primary speaker cabinet 105 in order to emanate from the left side of the speaker cabinet 100. Sound holes may be located on both sides of the speaker cabinet 100 and usually correspond to the upper speakers of the sound cabinet 100 in order for sound from the upper speakers emanate from the sides of the speaker cabinet 100. The sound hole 138 generally allows sound produced by the musical instrument to resonate differently from the upper speakers than the fully enclosed lower speakers (chambers), thereby widening the frequency response from the speaker cabinet 100. In one embodiment, the sound chamber 115 may be configured for a 12" speaker. In an alternate embodiment, the sound holes would be on the lower sound chambers and speakers, and thus, sound chamber 115 may not have sound hole 205. In a preferred embodiment, the sound hole 205 may be approximately four inches in diameter.

The sound hole 138 is generally configured to provide additional sound/resonance and usually helps relieve air pressure naturally created by the movement of the speaker housed within the sound chamber 115 with the sound hole 138. This generally creates a natural variance in tonality between the corresponding lower sound chambers 120, 125 and the upper sound chambers 110, 115 containing the sound holes.

Figure 5:
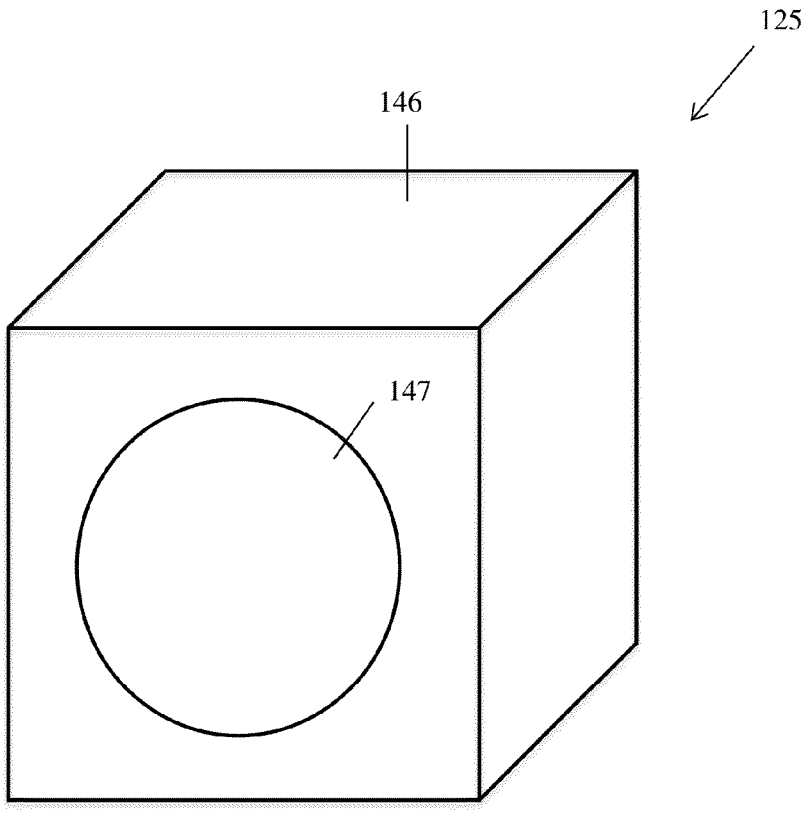
FIG. 5 is an illustration of a perspective view of one embodiment of the lower right sound chambered speaker to be placed in the speaker cabinet.

FIG. 5 is an illustration of a perspective view of one embodiment of the lower right sound chambered speaker to be placed in the speaker cabinet. As shown in FIG. 5, one embodiment of the sound chamber 125 may comprise: a casing 146 and speaker hole 147. As shown, the casing 146 is generally a box-like structure that is configured to house a speaker. The casing 146 may comprise a speaker hole 147 for securely attaching speaker 145. In one embodiment, the sound chamber 125 may be configured for a 10" speaker.

Figure 6:
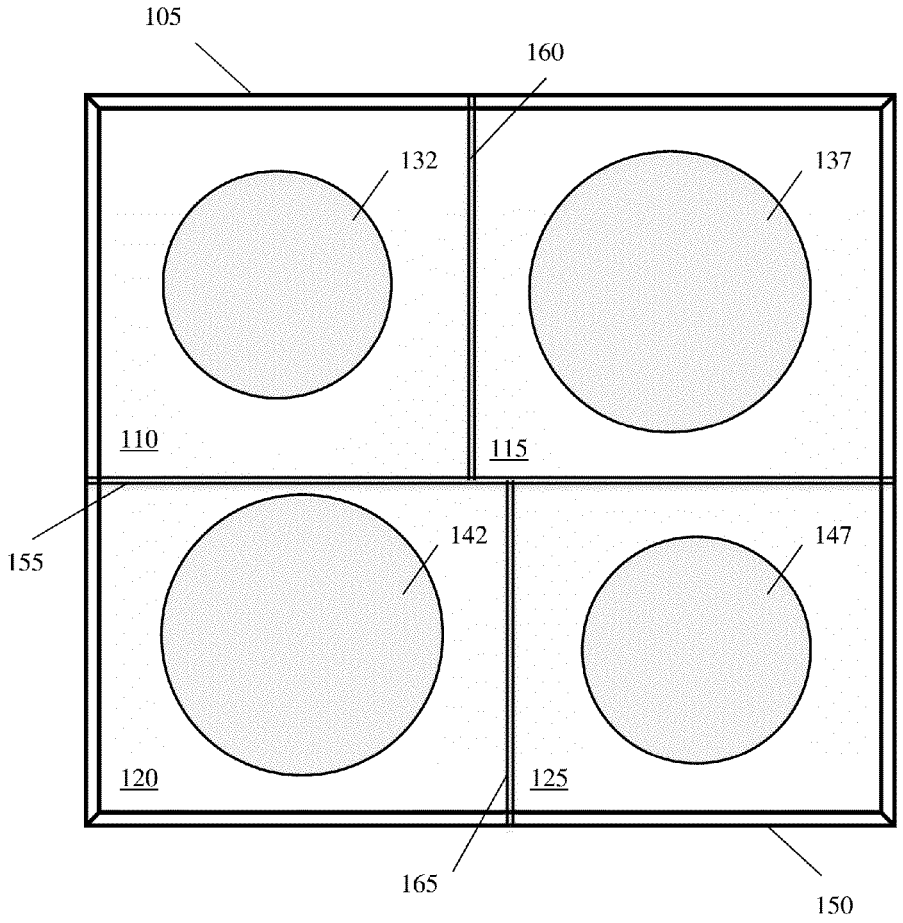
FIG. 6 is an illustration of one embodiment of the speaker cabinet and shows the four sound chambers integrated into the speaker cabinet.

FIG. 6 is an illustration of one embodiment of the speaker cabinet and shows the four sound chambers integrated into the speaker cabinet, without the speakers. As shown in FIG. 6, one embodiment of the speaker cabinet 100 may comprise: a primary speaker cabinet 105, exterior wall 150, horizontal partition 155, first vertical partition 160, second vertical partition 165, and sound chambers 110, 115, 120, 125. Sound chambers 110, 125 are generally configured to fit a first set of speakers of the same size as each other, while sound chambers 115, 120 are generally configured to fit a second set of speakers that are the same size as each other, but different from the first set of speakers. For example, in a preferred embodiment, the speakers held by sound chambers 110, 125 may be 10" speakers, while the speakers held by sound chambers 115, 120 may be 12" speakers. Although FIG. 6 shows a speaker cabinet and primary speaker cabinet for four sound chambers, it should be understood that the speaker cabinet and primary speaker cabinet could be configured for any number of sound chambers and speakers.

FIG. 7 is an illustration of a rear perspective view of one embodiment of the speaker cabinet and shows the left and back sides of the speaker cabinet. As shown in FIG. 7, one embodiment of the speaker cabinet 100 may comprise: a primary speaker cabinet 105, sound hole 205, first cable 210, and second cable 215. The first cable 210 may connect to the first set of speakers 135, 140, while the second cable 215 may connect to the second set of speakers 130, 145. For example, in a preferred embodiment, these connections may be exclusive. Thus, an audio-based electrical signal traveling through the first cable 210 may be heard only through the 12" speakers while an audio-based electrical signal traveling through the second cable 215 may be heard only through the 10" speakers.

The sound hole 205 generally allows sound to emanate from the left side of speaker cabinet 100, and generally allows sound produced by the sound generating device, such as a musical instrument, to resonate differently from the upper speakers than the fully enclosed lower speakers, thereby widening the frequency response from the speaker cabinet 100. In a preferred embodiment, the sound hole 205 may be approximately four inches in diameter.

Additionally, while most conventional speaker cabinets available are generally coated or covered in dampening material such as latex or vinyl, the speaker cabinet 100 disclosed herein is preferably not coated or covered in latex or vinyl. This generally allows the sound resonance to increase. Although FIG. 7 shows only two cables, any number of cables may be used for any number of speakers.

FIG. 8 is an illustration of a front perspective view of one embodiment of the speaker cabinet and shows the right and front sides of the speaker cabinet. As shown in FIG. 8, one embodiment of the speaker cabinet 100 may comprise: a primary speaker cabinet 105, sound hole 206, first cable 210, second cable 215, and screen 220. The sound hole 206 generally allows sound to emanate from the right side of the speaker cabinet 100. The screen 220 is a cover, typically mesh, which generally protects the speakers from the elements such as dust but allows sound to pass through.

Figure 9:
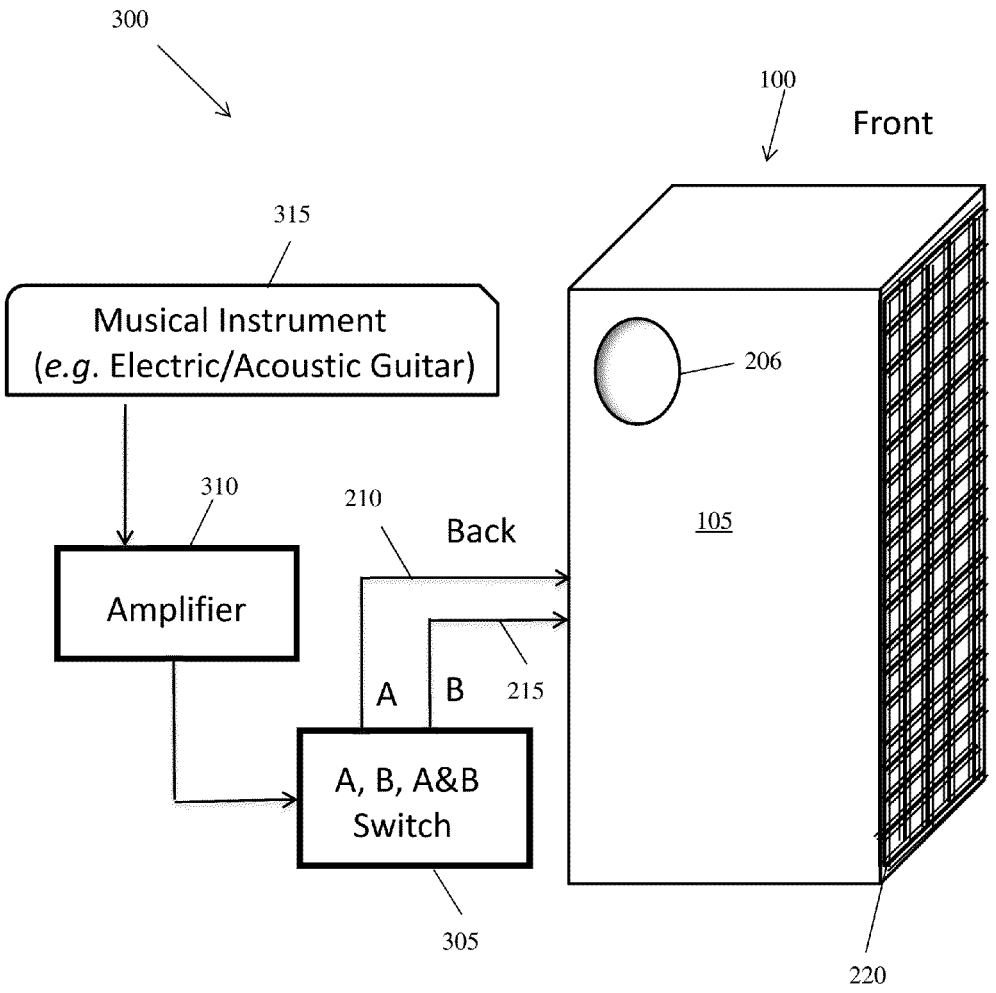
FIG. 9 is a block diagram and illustration of one embodiment of a speaker cabinet system and shows the interconnections among the speaker cabinet, switch, amplifier, and musical instrument, or other sound source to be amplified.

FIG. 9 is a block diagram and illustration of one embodiment of a speaker cabinet system and shows the interconnections among the speaker cabinet, switch, amplifier, and musical instrument, or other sound source to be amplified. As shown in FIG. 9, one embodiment of the system 300 may comprise: a speaker cabinet 100, switch 305, amplifier 310, and musical instrument 315. The speaker cabinet 100 may comprise: a primary speaker cabinet 105, sound hole 206, first cable 210, second cable 215, and screen 220. The musical instrument 315 is generally any device adapted to make musical sounds such as a guitar or electric/acoustic guitar. In an alternate embodiment, the musical instrument 315 may be any sound generation device, such as an MP3 player, tape player, or compact disc player. The amplifier 310 is generally an electronic device for increasing the amplitude of electrical signals that is generally used in sound reproduction, and may be used to increase the audio signal from the musical instrument 315. The switch 305 is generally a device for making, breaking, or changing the connections in an electrical circuit and may be used to connect and transfer the audio-based information from the amplifier to either the first cable 210 or second cable 215. The switch 305 may also be used to modify the audio signal. In a preferred embodiment, the switch 305 is generally a foot switch, which may be activated by the foot of a user that is playing one or more of the musical instruments 315. The first cable 210 and second cable 215 is generally configured to transfer the audio based information from the switch 305 to the speaker cabinet 100 or speakers contained therein, and additional cables may be used in other embodiments to increase customization.

FIG. 9 also shows how sound travels from the musical instrument 315 to the speaker cabinet 100. The musical instrument 315 may create musical sounds or electrical signals, which may travel to the input of an amplifier 310 via a connection or cable. The amplifier 310 then may increase the amplitude of the electrical signals and may transfer the electrical signal to the switch 305. The user of the system 300 may then select which speakers will receive the electrical signal from the switch 305 (e.g., foot switch) and produce the sound. For example, in one embodiment, the first cable 210 may connect to the first set of speakers 135, 140, while the second cable 215 may connect to the second set of speakers 130, 145. Thus, the user may select whether speakers 135, 140, speakers 130, 145, or all four will receive the electrical signal from or through the switch 305. As the electrical signals travel to the speakers of the speaker cabinet 100, sound preferably emanates from the front of the speakers and may travel through the sound holes 206, 205 of the speaker cabinet 100. Due to the lack of dampening material such as vinyl coating (e.g., Tolex®) or texture, the resonance of the sound may be a lot higher than if a coating was in place.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A speaker cabinet, comprising:
a primary speaker cabinet;
at least four sound chambers; and
at least four speakers;
wherein said at least four sound chambers contain said at least four speakers;
wherein said at least four sound chambers are substantially enclosed within said primary speaker cabinet; and
wherein said at least four sound chambers are arranged in a radially symmetric manner in said primary speaker cabinet, such that, at least two of said at least four sound chambers are disposed vertically and horizontally asymmetrical in size, but are diagonally symmetrical in size.

2. The speaker cabinet of claim 1, wherein said at least four speakers comprise a first set of speakers and a second set of speakers;
wherein said first set of speakers are the same size as each other;
wherein said second set of speakers are the same size as each other; and
wherein said first and second set of speakers are different sizes.

3. The speaker cabinet of claim 1, further comprising:
a plurality of partitions;
wherein said plurality of partitions are configured to divide an interior of said primary speaker cabinet into a plurality of compartments; and
wherein each of said plurality of compartments are configured to receive each of said at least four sound chambers.

4. The speaker cabinet of claim 1, wherein said primary speaker cabinet and said at least four sound chambers lack a dampening material.

5. The speaker cabinet of claim 1, wherein said primary speaker cabinet is constructed of a wood.

6. The speaker cabinet of claim 5, wherein said wood is dense, thin, and solid.

7. The speaker cabinet of claim 1, wherein said primary speaker cabinet comprises one or more sound holes.

8. The speaker cabinet of claim 7, wherein said one or more sound holes are positioned at an upper portion of at least one side of said primary speaker cabinet.

9. The speaker cabinet of claim 7, wherein at least one of said at least four sound chambers comprise said one or more sound chamber sound holes.

10. The speaker cabinet of claim 7, wherein said one or more sound chamber sound holes substantially match up with said one or more sound holes of said primary speaker cabinet, such that sound may emanate through both said one or more sound chamber sound holes and said one or more sound holes of said primary speaker cabinet.

11. The speaker cabinet of claim 1, further comprising:
a switch;
wherein said switch comprises an input and at least two outputs;
wherein said input of said switch is configured to receive an amped sound signal sent by an amplified musical instrument;
wherein said at least two outputs of said switch are configured to connect to said first set of speakers and said second set of speakers; and
wherein said switch is configured to allow a user to toggle between said first set of speakers, said second set of speakers, and both of said sets of speakers such that said amped sound signal created by said amplified musical instrument is produced from said first set of speakers, said second set of speakers, or both of said sets of speakers.

12. A speaker cabinet, comprising:
a primary speaker cabinet;
at least four sound chambers; and
at least four speakers;
wherein said at least four sound chambers contain said at least four speakers;
wherein said at least four sound chambers are substantially enclosed within said primary speaker cabinet; and
wherein said at least four sound chambers are arranged in a radially symmetric manner in said primary speaker cabinet, such that, at least two of said at least four sound chambers are disposed vertically and horizontally asymmetrical in size, but are diagonally symmetrical in size.

13. The speaker cabinet of claim 11, wherein said at least four speakers comprise a first set of speakers and a second set of speakers;
wherein said first set of said one or more speakers are ten inch speakers;
wherein said second set of said one or more speakers are twelve inch speakers.

14. The speaker cabinet of claim 12, wherein said primary speaker cabinet and said at least four sound chambers lack a dampening material.

15. The speaker cabinet of claim 13, wherein said primary speaker cabinet is constructed of a wood;
wherein said wood is dense, thin, and solid.

16. The speaker cabinet of claim 14, wherein said primary speaker cabinet comprises one or more sound holes.

17. The speaker cabinet of claim 15, wherein said one or more sound holes are positioned at an upper portion of at least one side of said primary speaker cabinet.

18. The speaker cabinet of claim 16, wherein at least one of said at least four sound chambers comprise said one or more sound chamber sound holes.

19. The speaker cabinet of claim 17, wherein said one or more sound chamber sound holes substantially match up with said one or more sound holes of said primary speaker cabinet, such that sound may emanate through both said one or more sound chamber sound holes and said one or more sound holes of said primary speaker cabinet.

20. A speaker cabinet, comprising:

a primary speaker cabinet;

four sound chambers;

four speakers;

a plurality of partitions; and a switch;

wherein said four sound chambers contain said four speakers;

wherein said four speakers comprise ten inch speakers and twelve inch speakers;

wherein said four sound chambers are substantially enclosed within said primary speaker cabinet;

wherein said four sound chambers are arranged in a radially symmetric manner in said primary speaker cabinet, such that, two of said four sound chambers are disposed vertically and horizontally asymmetrical in size, but are diagonally symmetrical in size;

wherein said primary speaker cabinet and said four sound chambers lack a dampening material;

wherein said primary speaker cabinet is constructed of a wood;

wherein said wood is dense, thin, and solid;

wherein said primary speaker cabinet comprises a first sound holes and a second sound hole;

wherein said first sound hole is positioned at an upper portion of a right side of said primary speaker cabinet;

wherein said second sound hole is positioned at an upper portion of a left side of said primary speaker cabinet;

wherein two of said four sound chambers also comprise said first sound chamber sound hole and said second sound chamber sound hole;

wherein said first sound chamber sound hole substantially match up with said first sound hole of said primary speaker cabinet, such that sound may emanate through both said first sound chamber sound hole and said first sound hole of said primary speaker cabinet;

wherein said second sound chamber sound hole substantially match up with said second sound hole of said primary speaker cabinet, such that sound may emanate through both said second sound chamber sound hole and said second sound hole of said primary speaker cabinet;

wherein said plurality of partitions are configured to divide an interior of said primary speaker cabinet into four compartments;

wherein each of said four compartments are configured to receive each of said four sound chambers;

wherein said switch comprises an input and at least two outputs;

wherein said input of said switch is configured to receive an amped sound signal sent by an amplified musical instrument;

wherein said at least two outputs of said switch are configured to connect to said first set of speakers and said second set of speakers; and wherein said switch is configured to allow a user to toggle between said first set of speakers, said second set of speakers, and both of said sets of speakers such that said amped sound signal created by said amplified musical instrument is produced from said first set of speakers, said second set of speakers, or both of said sets of speakers.

* * * * *